United States Patent [19]

Kotz

[11] Patent Number: 4,970,353

[45] Date of Patent: Nov. 13, 1990

[54] PROTECTIVE COVER FOR EXPOSED TRANSFORMER TERMINALS

[75] Inventor: Jeffrey F. Kotz, Niles, Ill.

[73] Assignee: AG Communication Systems Corporation, Phoenix, Ariz.

[21] Appl. No.: 328,658

[22] Filed: Mar. 27, 1989

[51] Int. Cl.[5] ..... H01F 15/10; H01R 13/44

[52] U.S. Cl. ..... 174/138 F; 336/192

[58] Field of Search ..... 174/138 F; 336/192, 336/198, 208; 439/135, 149, 528, 718, 892, 893

[56] References Cited

U.S. PATENT DOCUMENTS

| | | | |
|---|---|---|---|
| 4,027,279 | 5/1977 | Shigehara | 174/138 F X |
| 4,206,435 | 6/1980 | Harris et al. | 174/138 F X |
| 4,257,027 | 3/1981 | Yasuhisa | 336/192 |
| 4,363,014 | 12/1982 | Leach et al. | 174/138 F X |

OTHER PUBLICATIONS

Pyde, A. F. et al., "A Machine for Assembling a Plastic Cover on a Switchblock", *Western Electric Technical Digest,* No. 57, Jan. 1980, pp. 17 and 18.

*Primary Examiner*—Laramie E. Askin

*Attorney, Agent, or Firm*—Anthony Miologos

[57] ABSTRACT

For use with transformers, a protective cover device for protecting exposed transformer terminals from external forces which may damage the terminal to coil lead wire connection. The protective cover includes a rear flange having first and second legs extending perpendicularly from opposite minor edges of the rear flange. A generally L-shaped guard structure having a large radiused knee extends from the rear flange. An inner surface of each of the first and second legs includes mounting devices arranged to interlockingly engage the transformer, thereby positioning the guard structure to shroud and protect the transformer terminals.

3 Claims, 1 Drawing Sheet

PROTECTIVE COVER FOR EXPOSED TRANSFORMER TERMINALS

BACKGROUND OF THE INVENTION

This invention relates in general to protective covers and, more particularly, to a protective cover designed to prevent accidental damage of transformer terminals and coil winding connections during handling and installation of the transformer.

In modern telecommunication systems, voice transmissions between a central office telephone switching system and a subscriber are normally accomplished via an electronic interface known in the art as a subscriber line card. The voice transmissions are coupled to a subscriber line via a line circuit which includes an audio frequency transformer.

In order to mount many line circuits to the abovementioned subscriber line card, the line circuit transformers have been miniaturized. However, the miniaturization of the transformer has necessitated the use of components, such as coil wires and terminals, of such small physical size and dimension that forces as small as 2.3 lbs exerted on the transformer terminals are sufficient to cause the transformer terminal ends to deflect and the coil winding connections to break. This results in an intermittent connection at the point of attachment of the coil windings to the transformer terminal. This intermittent connection between the transformer terminals and coil windings manifests itself to the subscriber as call cut-off, intermittent transmission loss and voice fading, severely impacting the reliability and quality of the telecommunication service provided to the subscriber.

The displacement of the terminals with the subsequent damage of the coil winding lead wires has been found to occur from incidental contact with human fingers during manufacturing, handling and cleaning of the transformers. Additionally, displacement of the terminals may occur during manufacture by a misalignment of the transformer in assembly fixtures.

It therefore becomes the object of the present invention to provide a protective cover which can be easily fitted to the transformer thereby protecting the terminals of the transformer from external forces which may damage the lead wires of the transformer.

SUMMARY OF THE INVENTION

The above and other objects, advantages, and capabilities of the invention are realized in a protective cover arranged to be used with a transformer device. The transformer device includes a terminal support structure having at least one transformer terminal mounted thereon.

The protective cover in accordance with the present invention comprises a planar rear flange having a first leg extending perpendicularly from a first minor edge of the rear flange. A second leg extends parallel to the first leg, from a second and opposite minor edge of the rear flange.

The protective cover of the present invention further includes a guard structure having a first wall coplanar to the rear flange, extending from a major edge of the rear flange. A second wall extends perpendicularly to the first wall. A large radiused knee joins the first wall to the second wall.

An inner surface of each of the first and second legs includes mounting devices arranged to interlockingly engage opposite ends of the transformer terminal support structure, thereby positioning the guard structure to shroud and protect the terminal.

BRIEF DESCRIPTION OF THE DRAWINGS

A better understanding of the invention may be had from the consideration of the following detailed description taken in conjunction with the accompanying drawings in which.

DESCRIPTION OF THE PREFERRED EMBODIMENT

Figure 1:
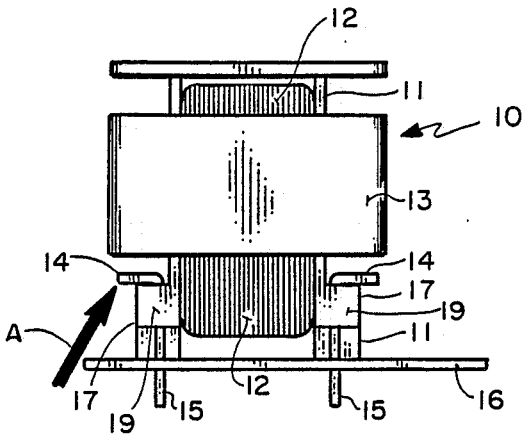
FIG. 1 is side elevational view of a transformer, of the type used to advantage by the present invention.

Turning now to FIG. 1, a transformer of the type used by the present invention is illustrated. The transformer 10 includes a bobbin 11, molded from a dielectric material such as a plastic or the like. The bobbin forms the supporting structure for the coil windings 12, and the magnetic core 13 The bobbin 11 further includes terminal support structures 17 having a plurality of L-shaped connecting terminals mounted therein. Each connecting terminal comprises a printed circuit board connecting leg 15, and a coil winding connecting leg 14. The transformer 10 is normally mounted and electrically interconnected to a printed circuit board 16 via connecting legs 15. Signals in the form of electrical voltages and currents are connected from the circuit board 16 and each connecting leg 15 to coils 12 via coil lead wires (not shown), which are soldered to a respective and individual coil winding connecting leg 14.

An external force applied to coil winding connecting legs 14 in the direction shown by arrow A would deflect coil winding connecting legs 14 and cause fracture of the coil lead wire to the terminal connection, with a resultant interruption of voltage and current flow to the coil.

Figure 2:
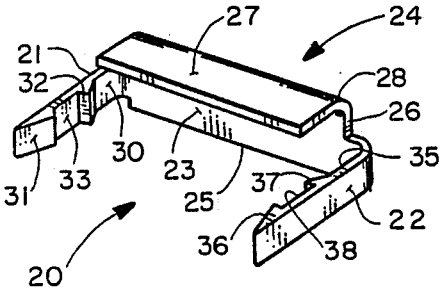
FIG. 2 is perspective view of the protective cover, in accordance with the present invention.

With reference to FIG. 2, the protective cover of the present invention is shown. The protective cover 20 is a generally U-shaped device comprising legs 21 and 22 extending from opposite minor edges of a rear flange 23. The rear flange 23 includes a standoff member 25 extending below the bottom edge of flange 23 and a guard plate 24 extending from a portion of the top edge of flange 23. The guard plate 24 is generally L-shaped in configuration and includes a first wall 26 extending in a coplanar and flush alignment with flange 23. A second wall 27 extends perpendicularly to the first wall 26. Walls 26 and 27 are integrally joined by a radiused edge 28.

An inner surface 30 of leg 21 includes ramped surfaces 31 and 32 which form an interlocking recess 33 therebetween. Similarly, leg 22 includes an inner surface 35 having ramped surfaces 36 and 37 defining an interlocking recess 38.

The protective cover 20 of the present invention is molded as a single unitary structure from a plastic material such as Cycolac® ABS.

Figure 3:
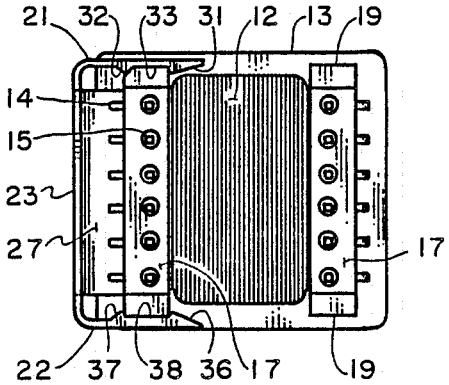
FIG. 3 is bottom plan view of the transformer of FIG. 1, having the protective cover installed, in accordance with the present invention.
Figure 4:
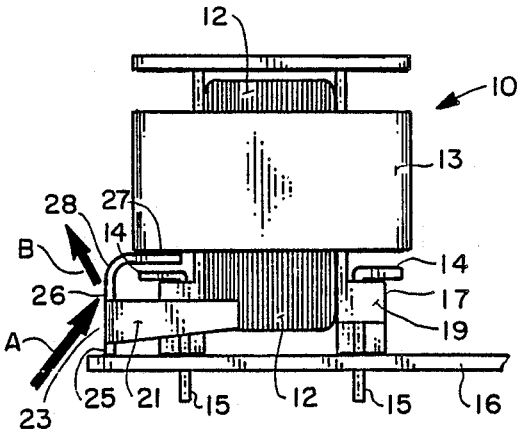
FIG. 4 is side elevational view of the transformer of FIG. 1, having the protective cover installed, in accordance with the present invention.

Turning now to FIGS. 3 and 4, the protective cover 20 is shown used to advantage in protecting the coil winding connecting legs 14 of the transformer 10, in accordance with the present invention. As can be seen, legs 21 and 22 of protective cover 20 are slid over surfaces 19 of the terminal support structure 17. Ramped surfaces 31 and 36 deflect legs 21 and 22 outward respectively, until each surface 19 falls into and is interlockingly engaged within a respective recess 33 and 38. Each leg 21 and 22 then applies a compressive force to a respective surface 19, retaining the protective cover 20 in position. Additionally, with legs 21 and 22 properly mounted to transformer 10, standoff 25 rests on circuit board 16, aiding in the retention of the protective cover 20 to transformer 10.

As can be seen in FIG. 4, with the protective cover 20 installed on transformer 10, the guard 24 extends in front of and over coil winding connecting legs 14 of the connecting terminals. An external force applied in the direction of arrow A would be deflected by the large radiused edge 28 of guard 24 in the direction of arrow B, thereby protecting the coil winding connecting legs 14 and the coil lead wire connections from damage.

The protective cover, just described, aids in the prevention of accidental damage of transformer coil winding connections due to unintentional contact of the transformer terminal ends. The protective cover is designed to be easily snapped in place on the transformer after the transformer has been assembled to a printed circuit board. Since the protective cover allows installation after assembly of a transformer to a printed circuit board, the protective cover can be just as easily installed to transformers in the field, thereby preventing damage to transformers that are already in use.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. A protective cover for a transformer said transformer including a terminal support structure having at least one terminal mounted thereon and first and second minor sides, said protective cover comprising:

a planar rear flange having a first leg extending perpendicularly from a first minor edge of said rear flange and a second leg extending perpendicularly from a second and opposite minor edge of said rear flange, said second leg oriented parallel to and in the same direction as said first leg;

a guard structure having a first wall extending from a major edge of said rear flange coplanar to said rear flange, a second wall extending perpendicularly to said guard structure first wall oriented parallel to and in the same direction as said first and second legs, and a radiused knee connecting said guard structure first wall to said guard structure second wall;

means for mounting said first leg to said transformer terminal support structure including first and second ramped surfaces positioned in a spaced relationship on an inner surface of said first leg, said first and second ramped surfaces on the inner surface of said first leg defining a recess therebetween, said recess of said first leg arranged to accept therein and interlockingly engage said first minor side of said transformer terminal support structure; and means for mounting said second leg to said transformer terminal support structure including first and second ramped surfaces positioned in a spaced relationship on an inner surface of said second leg, said first and second ramped surfaces on the inner surface of said second leg defining a recess therebetween, said recess of said second leg arranged to accept therein and interlockingly engage said second minor side of said transformer terminal support structure, for thereby positioning said guard structure to shroud said terminal.

2. The protective cover as claimed in claim 1, wherein:

said transformer is mounted to a printed circuit board, and said rear flange further includes a standoff structure extending from a second and opposite major edge of said rear flange, said standoff structure arranged to rest on said circuit board when said first and second walls are mounted to said transformer terminal support structure.

3. The protective cover as claimed in claim 1, wherein:

said protective cover is formed as a unitary structure from an ABS plastic that has flexural and insulating qualities.

* * * * *